US007676998B2

(12) United States Patent
Lessard

(10) Patent No.: US 7,676,998 B2
(45) Date of Patent: Mar. 16, 2010

(54) MULTI-FAMILY, MULTI-UNIT BUILDING WITH TOWNHOUSE FACADE HAVING INDIVIDUAL GARAGES AND ENTRIES

(75) Inventor: Christian Lessard, Vienna, VA (US)

(73) Assignee: The Lessard Group, Inc., Vienna, VA (US)

( * ) Notice: Subject to any disclaimer, the term of this patent is extended or adjusted under 35 U.S.C. 154(b) by 0 days.

(21) Appl. No.: 11/979,189

(22) Filed: Oct. 31, 2007

(65) Prior Publication Data

US 2008/0289265 A1 Nov. 27, 2008

Related U.S. Application Data

(60) Provisional application No. 60/855,758, filed on Nov. 1, 2006.

(51) Int. Cl.
*E04H 1/00* (2006.01)
*E04F 11/00* (2006.01)

(52) U.S. Cl. ..... 52/234; 52/236.3; 52/236.6; 52/185

(58) Field of Classification Search ..... 52/234, 52/236.3, 236.6, 185, 169.4, 174, 182
See application file for complete search history.

(56) References Cited

U.S. PATENT DOCUMENTS

| | | | | | |
|---|---|---|---|---|---|
| 2,138,958 | A | * | 12/1938 | Corbett et al. | 52/238.1 |
| D207,201 | S | * | 3/1967 | Fonville | D25/4 |
| 3,479,781 | A | * | 11/1969 | Johnson | 52/169.3 |
| 3,874,137 | A | * | 4/1975 | Gentry | 52/169.1 |
| 4,041,661 | A | | 8/1977 | Hurwitz | |
| 4,596,097 | A | | 6/1986 | Stewart et al. | |
| 4,763,451 | A | | 8/1988 | Butcher | |
| 4,920,711 | A | * | 5/1990 | Mitchell, Sr. | 52/169.2 |
| 5,469,673 | A | | 11/1995 | Raynor et al. | |
| 5,553,429 | A | * | 9/1996 | Schuster | 52/234 |
| 5,809,704 | A | * | 9/1998 | Stewart et al. | 52/169.4 |
| 5,941,034 | A | | 8/1999 | Frankfurt | |
| D423,680 | S | * | 4/2000 | Davis | D24/4 |
| 6,182,408 | B1 | * | 2/2001 | Poehler | 52/234 |
| 6,405,496 | B1 | | 6/2002 | Stewart et al. | |
| 6,550,197 | B1 | * | 4/2003 | Gray | 52/236.3 |
| 6,578,330 | B1 | | 6/2003 | Bergman et al. | |
| 6,698,147 | B2 | | 3/2004 | Bergman et al. | |
| 7,036,281 | B2 | | 5/2006 | Stewart et al. | |
| 7,320,200 | B1 | * | 1/2008 | Eisner | 52/236.1 |
| 2004/0006940 | A1 | * | 1/2004 | Gray | 52/236.3 |

OTHER PUBLICATIONS

"Unconventional High-Density Developments Create Spaces That Feel Like Home", The Washington Post—Katherine Salant, pp. 1-3, Oct. 2006.
"Pulte Homes—Find Your Home", http://www.pulte.com/homefinder/; 2007.
Office Action issued Jul. 2, 2009 in related Canadian Appl. No. 2,609,112.

* cited by examiner

*Primary Examiner*—Richard E Chilcot, Jr.
*Assistant Examiner*—Mark R Wendell
(74) *Attorney, Agent, or Firm*—Venable LLP; Ralph P. Albrecht; Christopher Ma

(57) ABSTRACT

An exemplary embodiment of the present invention may include a multifamily dwelling which may include: at least one building, which may include: a townhouse façade on at least a front of the building; at least three dwelling units in the building, each of the at least three dwelling units may include: an individual garage, and a non-shared, individual entry between each individual garage and an associated dwelling unit.

36 Claims, 4 Drawing Sheets

MULTI-FAMILY, MULTI-UNIT BUILDING WITH TOWNHOUSE FACADE HAVING INDIVIDUAL GARAGES AND ENTRIES

BACKGROUND

1. Field

This application relates generally to buildings and more particularly to residential multi-family dwelling unit buildings.

2. Related Background

Various conventional residential dwelling unit types exist including, e.g., but not limited to, apartments, flats, condominiums, townhouses, duplexes and single family houses. As cities grow, there is a need for increased dwelling unit densities that overcome shortcomings of conventional dwelling units.

SUMMARY OF EXEMPLARY EMBODIMENTS

In an exemplary embodiment of the present invention a multi-family dwelling having various useful, novel and non-obvious features, including an exemplary multi-family dwelling having an exemplary building which may include an exemplary townhouse façade which may include a plurality of exemplary dwelling units, each of which dwelling unit may have a private individual garage, and individual entry to an associated dwelling unit.

An exemplary embodiment of the present invention may include a multifamily dwelling which may include: at least one building which may include a townhouse façade on at least a front of the building; a plurality of dwelling units in the building, each of the dwelling units may include: an individual garage, and a non-shared individual entry between the individual garage and the dwelling unit.

One exemplary embodiment of the present invention may include the multifamily dwelling, where each of the dwelling units further may include: a tandem parking space.

One exemplary embodiment of the present invention may include the multifamily dwelling, where the tandem parking space is at least partially under the building.

One exemplary embodiment of the present invention may include the multifamily dwelling, where each of the dwelling units may include a front door in the townhouse façade.

One exemplary embodiment of the present invention may include the multifamily dwelling, where the individual garage may include a rear entrance garage.

One exemplary embodiment of the present invention may include the multifamily dwelling, where the individual garage may include a sub-dwelling space garage.

One exemplary embodiment of the present invention may include the multifamily dwelling, where the individual garage may include a ground level garage.

One exemplary embodiment of the present invention may include the multifamily dwelling, where the individual garage may include a below ground level garage.

One exemplary embodiment of the present invention may include the multifamily dwelling, where the multifamily dwelling achieves densities of up to 48 dwelling units per acre.

One exemplary embodiment of the present invention may include the multifamily dwelling, where the at least one building may include at least one of: a first level may include parking, a second level may include a flat, and/or a third and fourth levels may include a townhouse.

One exemplary embodiment of the present invention may include the multifamily dwelling, where the plurality of dwelling units in the at least one building may include: three (3) of the dwelling units. In another exemplary embodiment, four (4) or more dwelling units may be provided.

One exemplary embodiment of the present invention may include the multifamily dwelling, where the building may include a width of at least one of: 30', 32', 34', 36', 38', 40', 42', 44', 46', up to 46', and/or between 30' and 46' inclusive.

One exemplary embodiment of the present invention may include the multifamily dwelling, where the building may include a depth of at least one of: greater than or equal to 30', and less than or equal to 30'; 32'; 34'; 36'; 38'; 40'; 42'; 44', 46', up to 46', and/or between 30' and 46' inclusive.

One exemplary embodiment of the present invention may include the multifamily dwelling, where the building may include a construction type which may include wood construction.

One exemplary embodiment of the present invention may include the multifamily dwelling, where the construction type further may include an absence of at least one of a concrete, and/or steel, floor separation between parking and the dwelling units.

One exemplary embodiment of the present invention may include the multifamily dwelling, where the building may include a modular that can easily fit into a townhouse modular.

One exemplary embodiment of the present invention may include the multifamily dwelling, where the townhouse modular may include at least one of a front and/or a back entrance garage.

One exemplary embodiment of the present invention may include the multifamily dwelling, where the townhouse modular may include a depth between 30' and 46' deep.

One exemplary embodiment of the present invention may include the multifamily dwelling, where the multifamily dwelling unit further may include a townhouse inserted into sticks to make up any waste in a block.

One exemplary embodiment of the present invention may include the multifamily dwelling, where the multifamily dwelling unit may further include a townhouse in a space exceeding at least one of: 30', 32', 34', 36', 38', 40', 42', 44', 46', up to '46, and/or between 30' and 46' inclusive. Another exemplary embodiment may include a unit in a space in excess of '46 wide and/or deep. In another exemplary embodiment, the multifamily dwelling unit may further include a townhouse in a space under approximately 30' wide and/or deep.

One exemplary embodiment of the present invention may include the multifamily dwelling, where the building may include a modular of a fee simple townhouse and coexists in a townhouse division.

One exemplary embodiment of the present invention may include the multifamily dwelling, where the multifamily dwelling may include a plurality of the buildings at least one of adjacent to one another and/or sharing a common wall between adjacent pairs of the plurality of the buildings.

One exemplary embodiment of the present invention may include the multifamily dwelling, where the multifamily dwelling may include a plurality of the buildings, wherein each of the buildings may include at least three of the dwelling units, with two of the individual garages sharing a common wall.

One exemplary embodiment of the present invention may include the multifamily dwelling, where the multifamily dwelling may include a plurality of the buildings, wherein each of the buildings may include at least four of the dwelling units, with at least two of the individual garages sharing a common wall. According to an exemplary embodiment, the multifamily dwelling may be intermixed with a conventional townhouse.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of various exemplary embodiments of the invention, as illustrated in the accompanying drawings wherein like reference numbers generally indicate identical, functionally similar, and/or structurally similar elements. The left most digits in the corresponding reference number indicate the drawing in which an element first appears.

DETAILED DESCRIPTION OF VARIOUS EXEMPLARY EMBODIMENTS OF THE INVENTION

Figure 1:
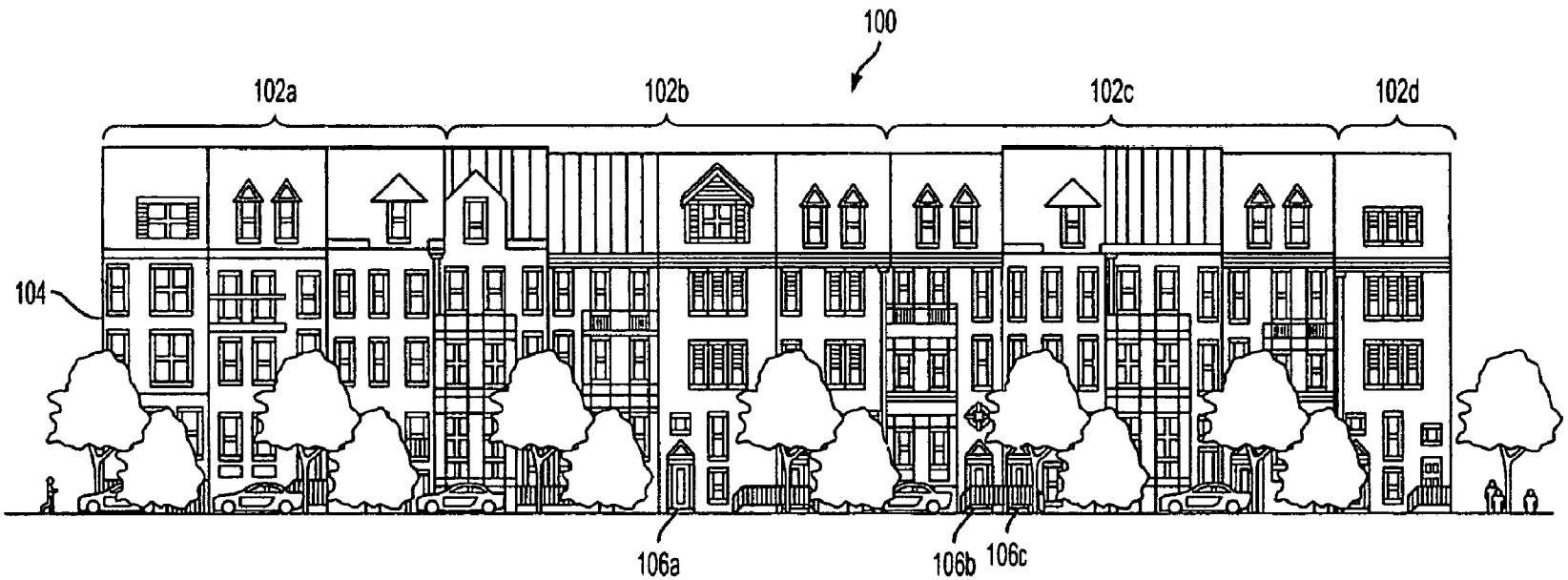
FIG. 1 depicts an illustration of an exemplary embodiment of a multi-family dwelling which may include in an exemplary embodiment, a plurality of buildings which may stand adjacent to one another, or which may share a common wall, which may have a townhouse façade, according to an exemplary embodiment of the present invention.

A preferred and various other exemplary embodiments of the invention are discussed in detail below. While specific exemplary embodiments are discussed, it should be understood that this is done for illustration purposes only. A person skilled in the relevant art will recognize that other components and configurations can be used without parting from the spirit and scope of the invention.

Conventional multi-family, multi-unit dwellings often include shared garages, or shared garages with a semi-private entryway, such as an elevator. U.S. Pat. Nos. 6,405,496 and 7,036,281 set forth, for example, a multi-family semi-private garage with semi-private entrances with shared corridors and a garage coupled to an elevator. Various other dwelling arrangements exist, however, conventionally, these have still failed to provide for sufficient densities to address the needs of urban and suburban living. Conventional duplexes provide for a pair of units which may share a wall. Townhouses with multiple entrances are set forth in U.S. Pat. No. 4,041,661. Multi-story apartments without garages are described in U.S. Pat. No. 5,941,034. Vertically stacked condominium units are described in U.S. Pat. Nos. 6,698,147 and 6,578,330. U.S. Pat. No. 5,469,673 describes front entrance townhouses with rear exits to a common passageway to a central common structure. U.S. Pat. No. 5,553,429 sets forth a bidirectional building with driveways entering opposite sides of a two adjacent dwelling units type building. U.S. Pat. No. 4,763,451 sets forth two houses, each with their own adjacent garages, all sharing one common roof. U.S. Pat. No. 5,809,704 sets forth a multi-story, multi-unit, multi-garage dwelling, with garages at different levels. U.S. Pat. No. 4,596,097 sets forth two oppositely faced garages set off from one another by a half a floor, for hillside housing. The contents of the above patents are incorporated herein by reference in their entireties. Conventional multi-family dwelling units usually include shared garages, or entrances.

An exemplary embodiment sets forth a multifamily dwelling which may include, in an exemplary embodiment, at least one building, which may include a townhouse façade on the front of the building; a plurality of dwelling units in the building, where each of the plurality of dwelling units may include an individual garage, and an individual entry between the individual garage and the dwelling unit. According to an exemplary embodiment, three (3), four (4), or more dwelling units may share the townhouse façade. In one exemplary embodiment, such a multi-family dwelling unit may be intermixed with a conventional townhouse. In an exemplary embodiment, the conventional townhouse and the multifamily dwelling unit may share an adjacent wall.

Useful, novel and non-obvious aspects of various exemplary embodiments may include an exemplary multifamily dwelling that may include, in an exemplary embodiment:

- providing a Townhouse-looking appearance façade on the multifamily dwelling;
- achieving individual entries for all units;
- achieving individual garages for all units, which may include, optionally, tandem parking, which may include exemplary partial under the building parking for the tandem;
- achieving densities of up to 48 units per acre;
- providing in one exemplary embodiment, parking on first level, dwelling on a second level as a flat, and dwelling on a third and fourth level as a townhouse;
- providing an exemplary, but not limiting, three (3) dwelling units, or more, which may include exemplary, but non-limiting, widths of 30', 32', 36', 38', 40', 42', 44', 46', up to 46', and/or between 30' and 46' inclusive wide configurations, which may include exemplary, but non-limiting, depths of up to 30', up to 46', and/or greater than or equal to 30', and less than or equal to 30'; 32'; 34'; 36'; 38'; 40'; 42'; 44'; 46'; up to 46'; and/or between 30' and 46' inclusive deep configurations (in another exemplary embodiment, the width and/or depth may be greater than 46', and in another, a width and/or depth of less than 30' may be provided. Although exemplary embodiments may include even lengths, odd numbered, or non-exact widths and/or depths may also be covered in various exemplary embodiments providing exemplary construction types which may include wood construction, with exemplary construction types which may be without concrete and/or steel floor separation between parking and dwelling units; and providing an exemplary modular, which may easily fit into a rear and/or front load townhouse modular, where the townhouse modular may be between 30' and 46' deep inclusive, or up to 46' deep and/or wide, (in other exemplary embodiments, the depth and/or width may be greater than 46', and/or less than 30') and may have a rear and/or front load townhouse, which may be inserted into sticks to make up any waste in a block.

FIG. 1 sets forth an exemplary front view of an exemplary embodiment of a multi-family dwelling 100, which may include in an exemplary embodiment, a plurality of various exemplary width buildings 102*a, b, c, d* (collectively 102) which may stand adjacent to one another, or which may share a common wall. Other width buildings may also be used. Also, alternative depth buildings may be used. Each of the plurality of buildings 102, according to an exemplary embodiment, may include a townhouse façade 104. Behind each townhouse façade 104, according to an exemplary embodiment, there may be multiple dwelling units 208*a, b, c* (208 collectively, not shown, described further with reference to FIG. 2) in each building. According to an exemplary embodiment, the front of the building may include private entryways 106*a, b, c* (collectively 106), each to an associated dwelling unit. According to an exemplary embodiment, the front private entryways 106 may comprise a front door in a townhouse façade 104. According to an exemplary feature of an exemplary embodiment, large densities of dwelling units may be achieved without giving up private garages and private entrances for the dwellers. Also, according to an exemplary feature of an exemplary embodiment, multi-family, multi-dwelling unit buildings may stand adjacent to townhouses, and may fit within zoning requirements, as well as provide an aesthetically appealing appearance from the street, while achieving very high unit dwelling densities and private garage entrances described further below with reference to FIG. 2. Exemplary embodiments of the dwelling units may be used as affordable dwelling units (ADUs).

Figure 2:
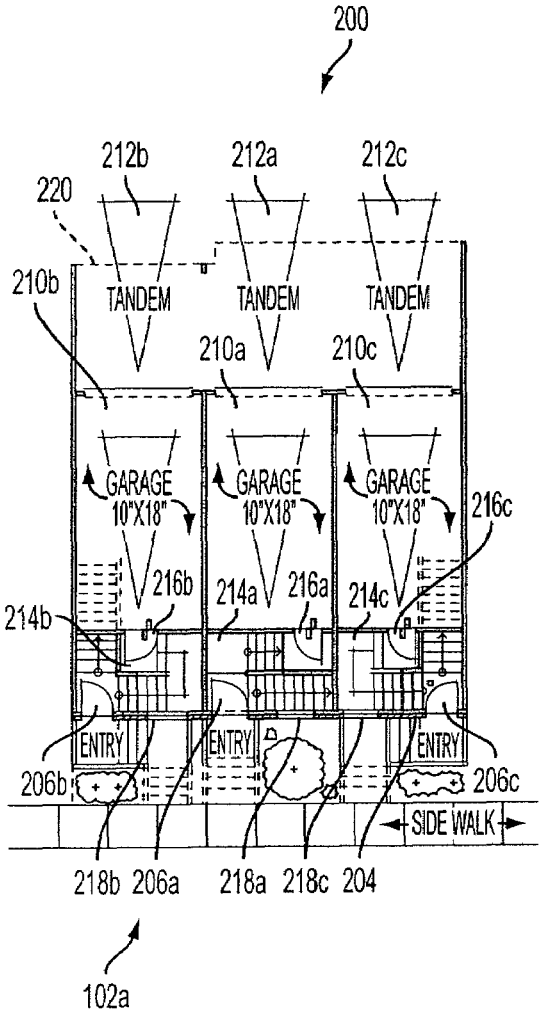
FIG. 2 depicts an illustration of an exemplary embodiment of an exemplary garage level, which may include an exemplary, but not limiting, three (3) exemplary side-by-side individual garages.

FIG. 2 sets forth an exemplary top view of an exemplary embodiment of an exemplary garage level 200 of an exemplary embodiment of the invention, which may include an exemplary three (3), or more, exemplary side-by-side individual garages 210*a, b, c* (collectively 210). Note that an exterior wall may include a shared townhouse façade 204, which may include, in an exemplary embodiment one or more doors and windows, which may appear to the observer as connected to a single dwelling unit whereas multiple dwelling units may in fact be behind the face of the building. According to an exemplary embodiment, each of a plurality, such as, e.g., but not limited to, three, four and/or more units, of the multiple dwelling units 208*a, b, c* (208 collectively, not shown, described further with reference to FIGS. 3-6, below) in each building may each have an associated one of the individual garages 210. According to an exemplary embodiment, each garage 210 may include a private entry 214*a, b, c* (collectively 214), which may include private access 216*a, b, c* (collectively 216) to an associated dwelling unit 208. According to an exemplary embodiment, a private entry 214 between each garage 210 and associated dwelling unit 208 may comprise a private corridor (not shared with any other unit) which may include, e.g., but not limited to, a passageway of stairs, a ramp, an escalator, and/or an elevator, etc. According to an exemplary embodiment, the garages 210 may be at a ground level. According to other exemplary embodiments, the garages may be below ground, or above ground level, or partially above and below (not shown). The garages 210 may be rear entry according to one exemplary embodiment. The garages may also be front entry (or side entry for end units), according to other exemplary embodiments (not shown). According to an exemplary embodiment, the rear garages 210 may be, e.g., but need not be, side by side and/or adjacent one another. According to an exemplary embodiment, three (3), four (4), and/or more exemplary individual garages 210 may stand side by side, per building. According to an exemplary embodiment, multiple exemplary garages 210 in an exemplary building may all be of the same entry direction, may share a wall between pairs of adjacent garages, and may each be private from one another, while allowing private entry 214 into an associated dwelling unit 208 associated with each individual garage 210. According to an exemplary embodiment, each garage may accommodate a single car. According to another exemplary embodiment, one or more units may include a larger than one car, such as, e.g., but not limited to, a 1.5, 2, or more, car(s) garage.

According to an exemplary embodiment, the front of the building may include private entryways 206*a, b, c* (collectively 206) to an associated dwelling unit. According to an exemplary embodiment, the front entryway 206 may provide front access to a private entry/corridor/passageway 214. In an exemplary embodiment, a window 218*a, b, c* (collectively 218) may be included.

According to an exemplary embodiment, each individual garage 210, may further include a parking space 212*a, b, c* (collectively 212) in tandem (or separate from, not shown) with its associated garage 210. In one exemplary embodiment, the tandem space may be adjacent. In another exemplary embodiment, it need not be adjacent (not shown). According to an exemplary embodiment, the tandem parking space 212 may be at least partially under the building as represented by the dotted line 220. In another exemplary embodiment, one or more additional parking space(s) associated with dwelling units may be available (not shown).

Figure 3:
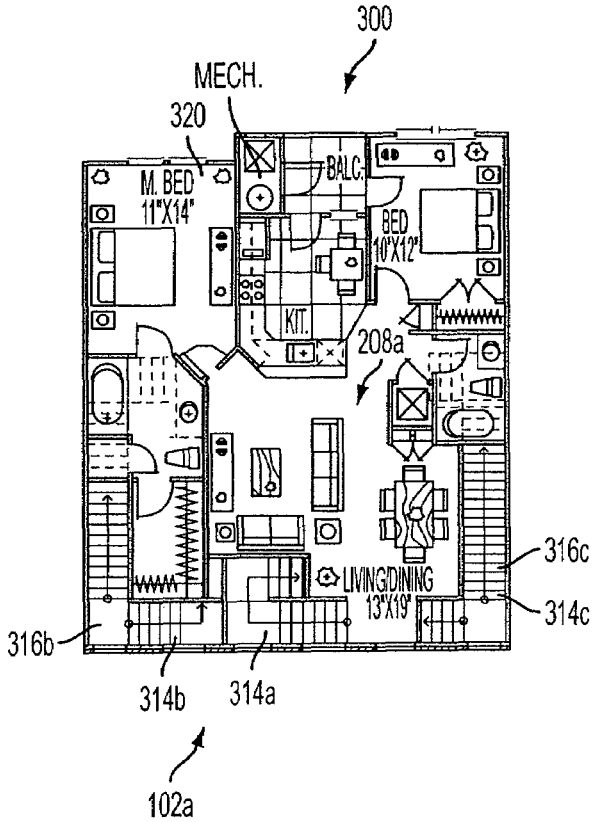
FIG. 3 depicts an illustration of an exemplary embodiment of an exemplary first level of an exemplary building, including an exemplary, but non-limiting single dwelling unit.

FIG. 3 sets forth an exemplary embodiment of an exemplary first level 300 of an exemplary building, including an exemplary single dwelling unit 320, also referred to as 208*a*. According to an exemplary embodiment, the exemplary single dwelling unit 320 may comprise a flat. According to an exemplary embodiment, the exemplary first level 300 of an exemplary building may include private entryways 314*a, b, c* (collectively 314) between dwelling units 208*a, b, c* and their associated individual garages 210*a, b, c*, respectively. According to an exemplary embodiment, the private entryway between dwelling units may not be of the same exemplary level and their associated individual garages may include, e.g., but not limited to, a passageway of stairs 316*b, c* (collectively 316), a ramp, an escalator or an elevator, etc., extending from the dwelling units 208*b, c* through the exemplary level 300 to an associated garage 210*b, c*, respectively. Various exemplary rooms are shown for the unit 320, such as, e.g., but not limited to, two bedroom(s), kitchen(s), balcony (ies), living room(s), dining room(s), bathroom(s), mechanical, passageway(s), hall(s), closet(s), window(s), and/or door(s), etc.

Figures 4, 5, 6:
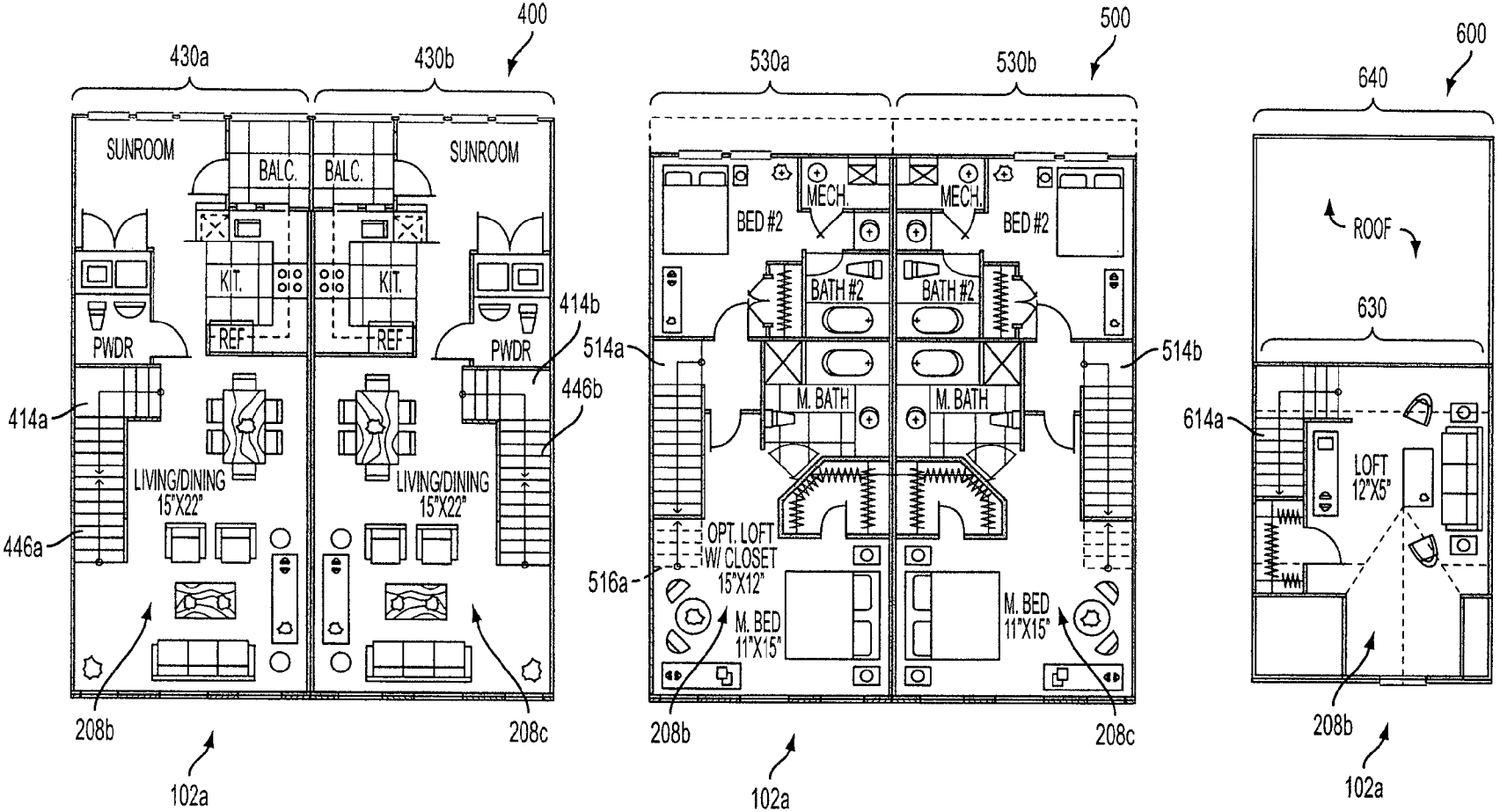
FIG. 4 depicts an illustration of an exemplary embodiment of an exemplary second floor plan of an exemplary building including an exemplary level of two exemplary, but non-limiting mirrored dwelling units.
FIG. 5 depicts an illustration of an exemplary embodiment of an exemplary third floor plan of an exemplary building including an exemplary additional level of the two exemplary, but non-limiting, mirrored dwelling units.
FIG. 6 depicts an illustration of an exemplary embodiment of an exemplary loft floor plan of an exemplary building including an exemplary, but non-limiting, loft level which may be included in an exemplary dwelling unit.

FIG. 4 sets forth an exemplary embodiment of an exemplary second floor plan 400 of an exemplary building including an exemplary level of two exemplary dwelling units 430*a, b* (collectively 430), also referred to as 208*b, c*, respectively, which may be mirrored, in an exemplary embodiment. According to an exemplary embodiment, the exemplary level may comprise the first level of two exemplary mirrored town home dwelling units. According to an exemplary embodiment, each exemplary mirrored dwelling unit 430 may include a private entryway 414*a, b* (collectively 414) to an associated individual garage 210*b*, 210*c*, respectively. According to an exemplary embodiment, each private entryway 414 ma y include, e.g., but not be limited to, a passageway of stairs, a ramp, an escalator, or an elevator, etc., extending from the dwelling unit through a lower level 300 to an associated garage 210. According to an exemplary embodiment, exemplary mirrored dwelling unit 430 may optionally include an additional passageway which may include, e.g., but not be limited to, stairs 446*a, b* (collectively 446), a ramp, an escalator, an elevator, etc., for access to an associated additional, such as, e.g., higher level. Since each dwelling unit may have its own private entryway 414 and may have access to its own private garage 210, dwellers are thus provided a secure, private access to the dweller's individual space, protecting the dweller's safety and security from other adjacent dweller(s) and their visitors, according to an exemplary embodiment.

FIG. 5 sets forth an exemplary embodiment of an exemplary third floor plan 500 of an exemplary building including an exemplary additional level of the two exemplary mirrored dwelling units 530*a, b* (collectively 530), also referred to as 208*b, c*, respectively. According to an exemplary embodiment, each exemplary mirrored dwelling unit 530 may include an exemplary private entryway 514*a, b* (collectively 514) to the adjacent lower level 430*a, b* via exemplary stairway 446*a, b*, respectively, which may further allow access from the private entryway to an individual garage. As shown, exemplary unit 208*b* may include an optional loft entry 516*a* for access to an optional loft described further below with reference to FIG. 6. According to an exemplary embodiment, the exemplary additional level 500 may comprise a higher, such as e.g., but not limited to, third level of an at least two level dwelling unit(s), which in the exemplary embodiment may include two exemplary mirrored town home dwelling units. As shown, each unit may include various exemplary rooms and features such as, e.g., but not limited to, bedroom(s), bath(s), closet(s), passageway(s), stairwell(s), hall(s), window(s), and/or door(s), etc.

FIG. 6 sets forth an exemplary embodiment of an exemplary (optional) loft floor plan 600 of an exemplary building including an exemplary, but not limited to, fourth, loft level 630 which may be included in an exemplary dwelling unit 208*b*. According to an exemplary embodiment, the exemplary loft level 630 may include a private entryway 614*a* (providing access to the adjacent lower level 530*a* of unit 208*b*). According to an exemplary embodiment, the exemplary loft level 630 may comprise the top level of an exemplary multiple level town home dwelling unit 208*b*. In an exemplary embodiment, the exemplary loft may be a portion of the entire area of the unit 102*a*, to permit a desired ceiling clearance below roof 640. In an exemplary embodiment, the loft may include, e.g., but is not limited to, a room(s), closet(s), bath(s), and/or window(s), etc. An exemplary embodiment may include, e.g., but not limited to, a gable and/or pediment.

Figure 7:
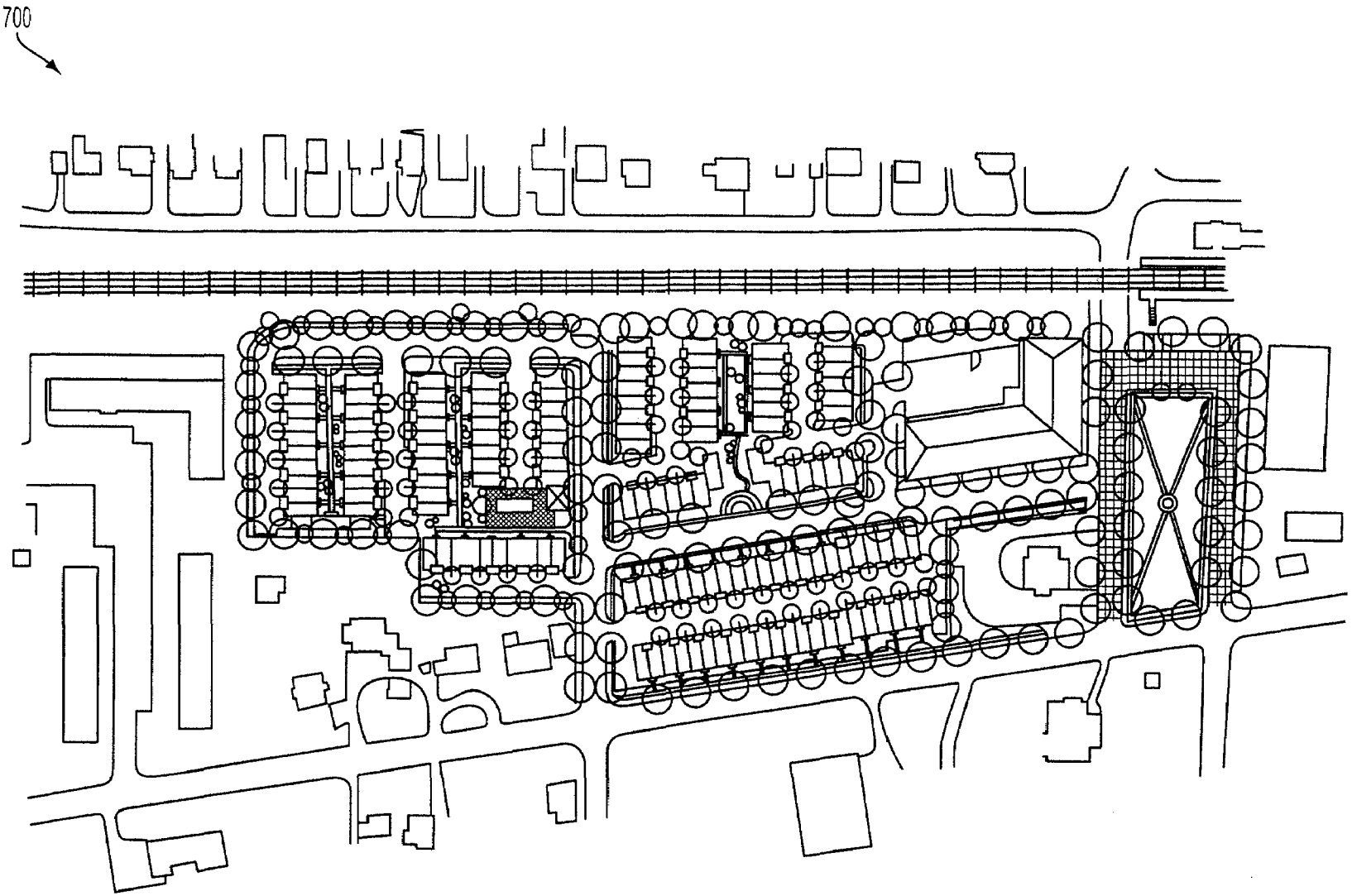
FIG. 7 depicts an illustration of an exemplary residential development including a plurality of the exemplary multi-family dwelling units, each of which may include a plurality of exemplary buildings, each of which buildings in turn may include a plurality of dwelling units, including three, four, or more dwelling units, each of which dwelling units may have an individual garage and individual entrance associated with the dwelling unit.

FIG. 7 sets forth an exemplary residential development including a plurality of the exemplary multifamily dwelling units, each of which may include, e.g., but may not be limited to, a plurality of exemplary buildings, each of which building in turn may include, e.g., but not limited to, a plurality of dwelling units, each of which dwelling units may have an exemplary individual garage and/or an individual entrance from the garage to the unit associated with the dwelling unit, according to an exemplary embodiment. According to an exemplary embodiment, a plurality of exemplary buildings may be adjacent to one another and/or may share a common wall between adjacent pairs of a plurality of buildings. According to an exemplary embodiment multifamily dwelling units may be integrated, side by side, adjacent, and/or in close proximity to single family dwelling units. Thus, in an exemplary embodiment, such multifamily dwelling units may be dispersed across a development, and/or throughout, as desired without detracting from the general single family dwelling units and/or townhouse units.

According to an exemplary embodiment, a plurality of multifamily multi-dwelling unit buildings may include a connector unit building, such as, e.g., but not limited to, building 102*d*, and each connector unit building may be adapted so as to provide one or more multifamily dwelling units complying with fair housing act requirements, statutes, regulations, rules, etc. In an exemplary embodiment, the connector unit may be a multifamily multi-dwelling unit building as previously described, with the addition of a ground floor accessible dwelling unit, which may include bathing, cooking and sleeping accommodations on the ground floor. In an exemplary embodiment, the dwelling unit may be wheelchair accessible. According to an exemplary embodiment, the ground floor accessible dwelling unit may include an area conventionally used by a driveway or an easement. In an exemplary embodiment, a connector unit may be the corner or end unit building 102*d* of a string of multifamily multi-dwelling unit buildings. In an exemplary embodiment, a conventional townhouse may take the place of a connector unit building to provide one or more multifamily dwelling units complying with fair housing act requirements, statutes, regulations, rules, etc.

Further well known systems may be used, although not shown, including, e.g., but not limited to, sprinkler systems, power, energy, electrical, plumbing, heating, ventilation, and air-conditioning (HVAC), septic, water (hot or cold), alarm, and/or security, etc.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A multifamily dwelling comprising:

at least one building comprising:

a front side comprising a front wall;

a back side comprising a back wall, opposite said front wall:

at least three levels;

at least three individual dwelling units between said front wall and said back wall each of said at least three individual dwelling units comprising:

an individual living area above a first level of said at least three levels;

an individual front door on said first level in said front wall adapted to provide private non-shared access between outside said at least one building and said individual living area;

an individual private non-shared garage adapted to store a vehicle on said first level comprising:

a first door on said first level adapted to provide access for the vehicle between outside said at least one building and said individual private non-shared garage, said first door on said back wall of said back side; and a second door adapted to provide private non-shared access between said individual private non-shared garage and said individual living area; and wherein said at least three individual dwelling units comprise a first individual dwelling unit and a second individual dwelling unit, wherein at least a portion of said individual living area of said first individual dwelling unit is directly above at least a portion of said individual living area of said second individual dwelling unit.

2. The multifamily dwelling according to claim 1, wherein each of said individual dwelling units further comprise:

a tandem parking space.

3. The multifamily dwelling according to claim 2, wherein said tandem parking space is at least partially under said at least one building.

4. The multifamily dwelling according to claim 1, wherein said individual private non-shared garage comprises a sub-dwelling space garage.

5. The multifamily dwelling according to claim 1, wherein said individual private non-shared garage comprises a ground level garage.

6. The multifamily dwelling according to claim 1, wherein said individual private non-shared garage comprises a below ground level garage.

7. The multifamily dwelling according to claim 1, wherein the multifamily dwelling achieves densities of up to 48 of said individual dwelling units per acre.

8. The multifamily dwelling according to claim 1, wherein said at least one building comprises at least one of:

a level comprising parking, a level comprising a flat, or a level comprising a townhouse.

9. The multifamily dwelling according to claim 1, wherein said at least one building comprises a width of at least one of:

30', 32', 34', 36', 38', 40', 42', 44', 46', up to 46', and/or between 30' and 46' inclusive.

10. The multifamily dwelling according to claim 1, wherein said at least one building comprises a depth of at least one of:

30', 32', 34', 36', 38', 40', 42', 44', 46', up to 46', and/or between 30' and 46' inclusive.

11. The multifamily dwelling according to claim 1, wherein said at least one building comprises a construction type comprising wood construction.

12. The multifamily dwelling according to claim 11, wherein said construction type further comprises wood, not a concrete, floor separation between parking and said individual dwelling units

13. The multifamily dwelling according to claim 1, wherein said at least one building comprises a modular that can fit into a townhouse modular.

14. The multifamily dwelling according to claim 13, wherein said townhouse modular comprises dimensions of between 30' and 46' wide and/or deep, inclusive.

15. The multifamily dwelling according to claim 1, wherein the multifamily dwelling further comprises a townhouse placed at a remaining portion of a surveyed block to use said remaining portion of said surveyed block.

16. The multifamily dwelling according to claim 1, wherein the multifamily dwelling further comprises a townhouse in a space exceeding 46' wide and/or deep.

17. The multifamily dwelling according to claim 1, wherein the multifamily dwelling further comprises a townhouse in a space less than 30' wide and/or deep.

18. The multifamily dwelling according to claim 1, wherein said at least one building comprises a modular of a townhouse and coexists in a townhouse division.

19. The multifamily dwelling according to claim 1, wherein the multifamily dwelling comprises a plurality of said buildings wherein said buildings are at least one of: adjacent to one another and/or sharing a common wall between adjacent pairs of said plurality of said buildings.

20. The multifamily dwelling according to claim 1, wherein the multifamily dwelling comprises a plurality of said buildings, wherein each of said buildings comprises at least five of said individual dwelling units, with two of said individual private non-shared garages sharing a common wall.

21. The multifamily dwelling according to claim 1, wherein the multifamily dwelling comprises a plurality of said buildings, wherein each of said buildings comprises at least four of said individual dwelling units, with at least two of said individual private non-shared garages sharing a common wall.

22. The multifamily dwelling according to claim 1, wherein said front wall of said front side comprises a plurality of rowhouse façades, each of said plurality of rowhouse façades comprising one of said individual front doors.

23. The multifamily dwelling according to claim 1, wherein a shape of at least one of said individual dwelling units does not correspond to a townhouse façade.

24. The multifamily dwelling according to claim 1, wherein said at least three individual dwelling units are provided on an equivalent of two townhouse lots.

25. The multifamily dwelling according to claim 1, wherein said individual private non-shared garage is at least partially under said at least one building.

26. The multifamily dwelling according to claim 1, wherein the each of said individual dwelling units comprises at least one of:

a townhouse;

a condominium; or an apartment.

27. The multifamily dwelling according to claim 1, wherein said front side of said at least one building faces at least one of: a street or a courtyard.

28. The multifamily dwelling according to claim 1, wherein each of said individual dwelling units comprises parking for at least one of: one vehicle, two vehicles, or at least three vehicles.

29. The multifamily dwelling according to claim 11, wherein said construction type further comprises wood, not a steel, separation between said parking and said individual dwelling units.

30. The multifamily dwelling according to claim 1, wherein said at least one building comprises at least four levels.

31. The multifamily dwelling according to claim 1, wherein said first level of said at least one building comprises no living area.

32. The multifamily dwelling according to claim 31, wherein the multifamily dwelling further comprises an additional dwelling unit having a living area on a first level, wherein said additional dwelling unit is coupled to said at least one building.

33. The multifamily dwelling according to claim 1, wherein said at least one building comprises at least four levels where said first level of said at least one building comprises no living area.

34. The multifamily dwelling according to claim 33, wherein said at least one building comprises at least five levels.

35. The multifamily dwelling according claim 1, wherein said at least three individual dwelling units comprise a third individual dwelling unit, wherein at least a portion of said individual living area of said third individual dwelling unit is directly above at least a portion of said individual living area of said second individual dwelling unit.

36. A multifamily dwelling comprising:

at least one building comprising:

a front side comprising a front wall;

a back side comprising a back wall, opposite said front wall;

at least four levels;

at least three individual dwelling units between said front wall and said back wall, each of said at least three individual dwelling units comprising:

an individual living area above a first level of said at least four levels;

an individual front door on said first level in said front wall adapted to provide private non-shared access between outside said at least one building and said individual living area;

an individual private non-shared garage adapted to store a vehicle on said first level comprising:

a first door on said first level adapted to provide access for the vehicle between outside said at least one building and said individual private non-shared garage, said first door on said back wall of said back side; and a second door adapted to provide private non-shared access between said individual private non-shared garage and said individual living area;

wherein said first level of said at least one building comprises no living area; and wherein said at least three individual dwelling units comprise a first individual dwelling unit and a second individual dwelling unit, wherein at least a portion of said individual living area of said first individual dwelling unit is directly above at least a portion of said individual living area of said second individual dwelling unit.

* * * * *